US009447647B2

(12) United States Patent
Lovorn et al.

(10) Patent No.: US 9,447,647 B2
(45) Date of Patent: Sep. 20, 2016

(54) PREEMPTIVE SETPOINT PRESSURE OFFSET FOR FLOW DIVERSION IN DRILLING OPERATIONS

(71) Applicant: HALLIBURTON ENERGY SERVICES, INC., Houston, TX (US)

(72) Inventors: James R. Lovorn, Tomball, TX (US); Nancy S. Davis, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 771 days.

(21) Appl. No.: 13/649,571

(22) Filed: Oct. 11, 2012

(65) Prior Publication Data

US 2013/0112404 A1 May 9, 2013

(30) Foreign Application Priority Data

Nov. 8, 2011 (WO) ..... PCT/US11/59743

(51) Int. Cl.
*E21B 21/08* (2006.01)
*E21B 33/08* (2006.01)

(52) U.S. Cl.
CPC ..... *E21B 21/08* (2013.01); *E21B 33/085* (2013.01)

(58) Field of Classification Search
CPC ..... E21B 21/08; E21B 21/10; E21B 34/02; E21B 47/06
See application file for complete search history.

(56) References Cited

U.S. PATENT DOCUMENTS 2,223,397 A 12/1940 White et al.
3,603,409 A 9/1971 Watkins
4,046,191 A 9/1977 Neath
4,063,602 A 12/1977 Howell et al.
4,099,583 A 7/1978 Maus
4,194,567 A 3/1980 Marais
4,275,788 A 6/1981 Sweatman
4,291,772 A 9/1981 Beynet
4,387,770 A 6/1983 Hill
4,627,496 A 12/1986 Ashford et al.
4,819,727 A 4/1989 Jennings, Jr.
4,880,060 A 11/1989 Schwendemann et al.

(Continued)

FOREIGN PATENT DOCUMENTS

CN 201593387 9/2010
EP 1432887 B1 3/2003

(Continued)

OTHER PUBLICATIONS

Halliburton; CFS-538, Product Data Sheet, dated 2011, 1 page.

(Continued)

*Primary Examiner* — Robert E Fuller
*Assistant Examiner* — David Carroll
(74) *Attorney, Agent, or Firm* — Chamberlain Hrdlicka

(57) ABSTRACT

A method of controlling pressure in a well can include transmitting an instruction to change flow through an annulus formed radially between a drill string and a wellbore, and adjusting a pressure setpoint in response to the transmitting. A well drilling system can include a flow control device which varies flow through a drill string, and a control system which changes a pressure setpoint in response to an instruction for the flow control device to change the flow through the drill string. A method of controlling pressure in a well can include transmitting an instruction to divert flow from a drill string, and adjusting a pressure setpoint in response to the transmitting.

9 Claims, 11 Drawing Sheets

(56) References Cited

U.S. PATENT DOCUMENTS

| | | | | |
|---|---|---|---|---|
| 5,006,845 | A | 4/1991 | Calcar | |
| 5,327,973 | A | 7/1994 | Jennings, Jr. | |
| 5,346,011 | A | 9/1994 | Onan et al. | |
| 5,483,986 | A | 1/1996 | Onan et al. | |
| 5,529,123 | A | 6/1996 | Carpenter et al. | |
| 5,720,356 | A | 2/1998 | Gardes | |
| 5,771,974 | A | 6/1998 | Stewart et al. | |
| 6,065,550 | A | 5/2000 | Gardes | |
| 6,145,591 | A | 11/2000 | Boncan et al. | |
| 6,173,768 | B1 | 1/2001 | Watson | |
| 6,230,824 | B1 | 5/2001 | Peterman et al. | |
| 6,263,982 | B1 | 7/2001 | Hannegan et al. | |
| 6,457,540 | B2 | 10/2002 | Gardes | |
| 6,662,110 | B1 | 12/2003 | Bargach et al. | |
| 6,668,943 | B1 | 12/2003 | Maus et al. | |
| 6,814,140 | B2 | 11/2004 | Robichaux | |
| 6,820,702 | B2 | 11/2004 | Niedermayr et al. | |
| 6,854,532 | B2 | 2/2005 | Fincher et al. | |
| 6,892,812 | B2 | 5/2005 | Niedermayr et al. | |
| 6,904,981 | B2 * | 6/2005 | van Riet | E21B 21/08 166/265 |
| 6,981,561 | B2 | 1/2006 | Krueger et al. | |
| 7,044,237 | B2 | 5/2006 | Leuchtenberg | |
| 7,055,627 | B2 | 6/2006 | Fontana et al. | |
| 7,090,036 | B2 | 8/2006 | DeBoer | |
| 7,096,975 | B2 | 8/2006 | Aronstam et al. | |
| 7,114,571 | B2 | 10/2006 | Gatherar et al. | |
| 7,134,489 | B2 | 11/2006 | Van Riet | |
| 7,174,975 | B2 | 2/2007 | Krueger et al. | |
| 7,185,718 | B2 | 3/2007 | Gardes | |
| 7,185,719 | B2 | 3/2007 | Van Riet | |
| 7,201,231 | B2 | 4/2007 | Chaplin et al. | |
| 7,207,399 | B2 | 4/2007 | Duhe et al. | |
| 7,237,613 | B2 | 7/2007 | Radi et al. | |
| 7,237,623 | B2 | 7/2007 | Hannegan | |
| 7,264,058 | B2 | 9/2007 | Fossli | |
| 7,270,185 | B2 | 9/2007 | Fontana et al. | |
| 7,278,496 | B2 | 10/2007 | Leuchtenberg | |
| 7,281,593 | B2 | 10/2007 | Steiner et al. | |
| 7,350,597 | B2 | 4/2008 | Reitsma et al. | |
| 7,353,887 | B2 | 4/2008 | Krueger et al. | |
| 7,367,410 | B2 | 5/2008 | Sangesland | |
| 7,367,411 | B2 | 5/2008 | Leuchtenberg | |
| 7,395,878 | B2 | 7/2008 | Reitsma et al. | |
| 7,497,266 | B2 | 3/2009 | Fossli | |
| 7,513,310 | B2 | 4/2009 | Fossli | |
| 7,562,723 | B2 | 7/2009 | Reitsma | |
| 7,650,950 | B2 | 1/2010 | Leuchtenberg | |
| 7,658,228 | B2 | 2/2010 | Moksvold | |
| 7,677,329 | B2 | 3/2010 | Stave | |
| 7,708,064 | B2 | 5/2010 | Sehsah | |
| 7,721,822 | B2 | 5/2010 | Krueger et al. | |
| 7,740,067 | B2 | 6/2010 | Bour et al. | |
| 7,762,329 | B1 | 7/2010 | Morgan et al. | |
| 7,806,203 | B2 | 10/2010 | Krueger et al. | |
| 7,913,774 | B2 | 3/2011 | Partouche | |
| 7,926,593 | B2 | 4/2011 | Bailey et al. | |
| 2002/0092655 | A1 | 7/2002 | Fincher et al. | |
| 2002/0108783 | A1 * | 8/2002 | Elkins | E21B 21/08 175/25 |
| 2002/0112888 | A1 | 8/2002 | Leuchtenberg | |
| 2003/0066650 | A1 | 4/2003 | Fontana et al. | |
| 2003/0098181 | A1 | 5/2003 | Aronstam et al. | |
| 2003/0127230 | A1 | 7/2003 | Von Eberstein, Jr. et al. | |
| 2003/0139916 | A1 | 7/2003 | Choe et al. | |
| 2003/0170077 | A1 | 9/2003 | Herd et al. | |
| 2003/0220742 | A1 | 11/2003 | Niedermayr et al. | |
| 2004/0040746 | A1 | 3/2004 | Niedermayr et al. | |
| 2004/0124008 | A1 | 7/2004 | Fincher et al. | |
| 2004/0206548 | A1 | 10/2004 | Aronstam et al. | |
| 2005/0092523 | A1 * | 5/2005 | McCaskill | E21B 21/08 175/38 |
| 2006/0006004 | A1 | 1/2006 | Terry et al. | |
| 2006/0065402 | A9 | 3/2006 | Fontana et al. | |
| 2006/0086538 | A1 | 4/2006 | Van Riet | |
| 2006/0169491 | A1 | 8/2006 | Fossli | |
| 2006/0207795 | A1 | 9/2006 | Kinder et al. | |
| 2007/0045006 | A1 | 3/2007 | Krueger et al. | |
| 2007/0068704 | A1 | 3/2007 | Krueger et al. | |
| 2007/0151762 | A1 | 7/2007 | Reitsma | |
| 2007/0168056 | A1 | 7/2007 | Shayegi et al. | |
| 2007/0240875 | A1 | 10/2007 | Van Riet | |
| 2007/0278007 | A1 | 12/2007 | Krueger et al. | |
| 2008/0041149 | A1 | 2/2008 | Leuchtenberg | |
| 2008/0060846 | A1 | 3/2008 | Belcher et al. | |
| 2008/0105434 | A1 | 5/2008 | Orbell et al. | |
| 2009/0139724 | A1 | 6/2009 | Gray et al. | |
| 2009/0211239 | A1 | 8/2009 | Askeland | |
| 2010/0006297 | A1 | 1/2010 | Stave | |
| 2010/0018715 | A1 | 1/2010 | Orbell et al. | |
| 2010/0186960 | A1 | 7/2010 | Reitsma et al. | |
| 2010/0288507 | A1 | 11/2010 | Duhe | |
| 2011/0009298 | A1 | 1/2011 | Dobson, Jr. et al. | |
| 2011/0094746 | A1 | 4/2011 | Allison et al. | |
| 2011/0139506 | A1 * | 6/2011 | Lovorn | E21B 21/10 175/25 |
| 2011/0139509 | A1 * | 6/2011 | Pool | E21B 21/08 175/50 |
| 2011/0259612 | A1 | 10/2011 | Lovorn et al. | |
| 2011/0290562 | A1 | 12/2011 | Standifird et al. | |
| 2012/0255776 | A1 | 10/2012 | Knudsen et al. | |
| 2012/0255777 | A1 | 10/2012 | Bernard | |

FOREIGN PATENT DOCUMENTS

| | | | |
|---|---|---|---|
| EP | 1488073 | B1 | 8/2003 |
| EP | 1595057 | B1 | 9/2004 |
| EP | 1664478 | B1 | 2/2005 |
| EP | 2053196 | A1 | 4/2009 |
| WO | 2009111412 | A1 | 9/2009 |
| WO | 2010071656 | | 6/2010 |
| WO | 2011043764 | A1 | 4/2011 |

OTHER PUBLICATIONS

Halliburton; "Baractive", Product Data Sheet, dated Sep. 3, 2010, 1 page.

Australian Office Action issued Oct. 2010 for AU Patent Application No. 2007317276, 2 pages.

International Search Report with Written Opinion issued Oct. 13, 2010 for PCT Patent Application No. PCT/US10/020122, 13 pages.

International Preliminary Report with Patentability issued Jun. 30, 2011 for PCT Patent Application No. PCT/US08/087686, 6 pages.

Office Action issued Sep. 16, 2011 for U.S. Appl. No. 12/299,411, 23 pages.

International Search Report with Written Opinion issued Nov. 21, 2011 for PCT Patent Application No. PCT/US11/036616, 13 pages.

Office Action issued Nov. 25, 2011 for U.S. Appl. No. 13/084,841, 19 pages.

International Search Report with Written Opinion issued Dec. 13, 2011 for PCT Patent Application No. PCT/US11/035751, 16 pages.

International Search Report with Written Opinion issued Dec. 21, 2011 for PCT Patent Application No. PCT/US11/031790, 15 pages.

Singapore Examination Report issued Dec. 27, 2011 for SG Patent Application No. 200903022-2, 8 pages.

Office Action issued Jan. 24, 2012 for U.S. Appl. No. 12/638,012, 18 pages.

U.S. Appl. No. 13/406,703, specification and drawings filed Feb. 28, 2012, 42 Pages.

Pre-Interview First Office Action issued Jul. 14, 2010 for U.S. Appl. No. 11/936,411, 14 pages.

International Search Report with Written Opinion issued Jun. 17, 2011 for PCT Patent Application No. PCT/US10/056433, 9 pages.

Office Action issued Feb. 7, 2012 for U.S. Appl. No. 13/022,964, 15 page.

International Search Report with Written Opinion issued Feb. 8, 2012 for PCT Patent Application No. PCT/US11/031767, 9 pages.

International Preliminary Report on Patentability issued Feb. 9, 2012 for PCT Patent Application No. PCT/US09/052227, 7 pages.

IRIS; "Automatic Coordination of Equipment while Circulating out a Kick and Displacing the Kill-Weight Mud", IADC Well Control Europe, dated 2010, 41 pages.

(56) References Cited

OTHER PUBLICATIONS

Office Action issued Mar. 14, 2012 for U.S. Appl. No. 12/299,411, 36 pages.
FAIPP Office Action issued Jul. 14, 2010 for U.S. Appl. No. 11/936,411, 16 pages.
Office Action issued Feb. 25, 2011 for U.S. Appl. No. 11/936,411, 66 pages.
Written Opinion issued May 17, 2010, for SG Patent Application Serial No. 2009030222, 2 pages.
GE Oil & Gas; "Hydril Pressure Control K Pulsation Dampers", product information, dated Aug. 6, 2010, 2 pages.
Chinese Office Action issued Feb. 22, 2012 for CN Patent Application No. 200780049409.0, 7 pages.
English Translation of Chinese Office Action issued Feb. 22, 2012 for CN Patent Application No. 200780049409.0, 7 pages.
Weatherford International Ltd.; "Weatherford Model 7800 Rotating Control Device", article No. 4593.00, dated 2007, 5 pages.
Weatherford International Ltd.; "Model 7875 Rotating Control Device", article No. 4594.01, dated 2010, 4 pages.
Hannegan, Don; Weatherford International; "Offshore Drilling Hazard Mitigation: Controlled Pressure Drilling Redefines What is Drillable", Managed Pressure Drilling Magazine, Drilling Contractor article, dated Jan.-Feb. 2009, 4 pages.
Smith Services; "Hold 2500 Rotating Control Device", product brochure, article No. ss-04-0055, dated 2004, 4 pages.
Smith Services; "Marine Riser RCD", product presentation, dated Jul. 2009, 18 pages.
Singapore Written Opinion issued May 17, 2010 for SG Patent Application No. 2009030222, 10 pages.
Pre-Interview First Office Action issued Jul. 29, 2010 for U.S. Appl. No. 11/936,411, 3 pages.
Singapore Office Action issued Feb. 15, 2011 for SG Patent Application No. 200903022, 9 pages.
Australian Examiners Report issued Mar. 7, 2011 for AU Patent Application No. 2007317276, 2 pages.
International Search Report and Written Opinion issued Jul. 27, 2011 for PCT Patent Application No. PCT/US2010/062394, 10 pages.
International Search Report with Written Opinion issued Aug. 9, 2012 for PCT Patent Application No. PCT/US2011/059743, 12 pages.
Halliburton Energy Services, Inc.; "Geo-Span Downlink Service", company article No. H06444, dated Nov. 2009, 2 pages.

* cited by examiner

PREEMPTIVE SETPOINT PRESSURE OFFSET FOR FLOW DIVERSION IN DRILLING OPERATIONS

CROSS-REFERENCE TO RELATED APPLICATION

This application claims the benefit under 35 USC §119 of the filing date of International Application Serial No. PCT/US11/59743 filed 8 Nov. 2011. The entire disclosure of this prior application is incorporated herein by this reference.

BACKGROUND

The present disclosure relates generally to equipment utilized and operations performed in conjunction with well drilling operations and, in an embodiment described herein, more particularly provides for pressure and flow control in drilling operations.

Managed pressure drilling is well known as the art of precisely controlling wellbore pressure during drilling by utilizing a closed annulus and a means for regulating pressure in the annulus. The annulus is typically closed during drilling through use of a rotating control device (RCD, also known as a rotating control head, rotating blowout preventer, etc.) which seals about the drill pipe as the wellbore is being drilled.

It will, therefore, be appreciated that improvements would be beneficial in the arts of controlling pressure and controlling flow in drilling operations.

DETAILED DESCRIPTION

Figure 1:
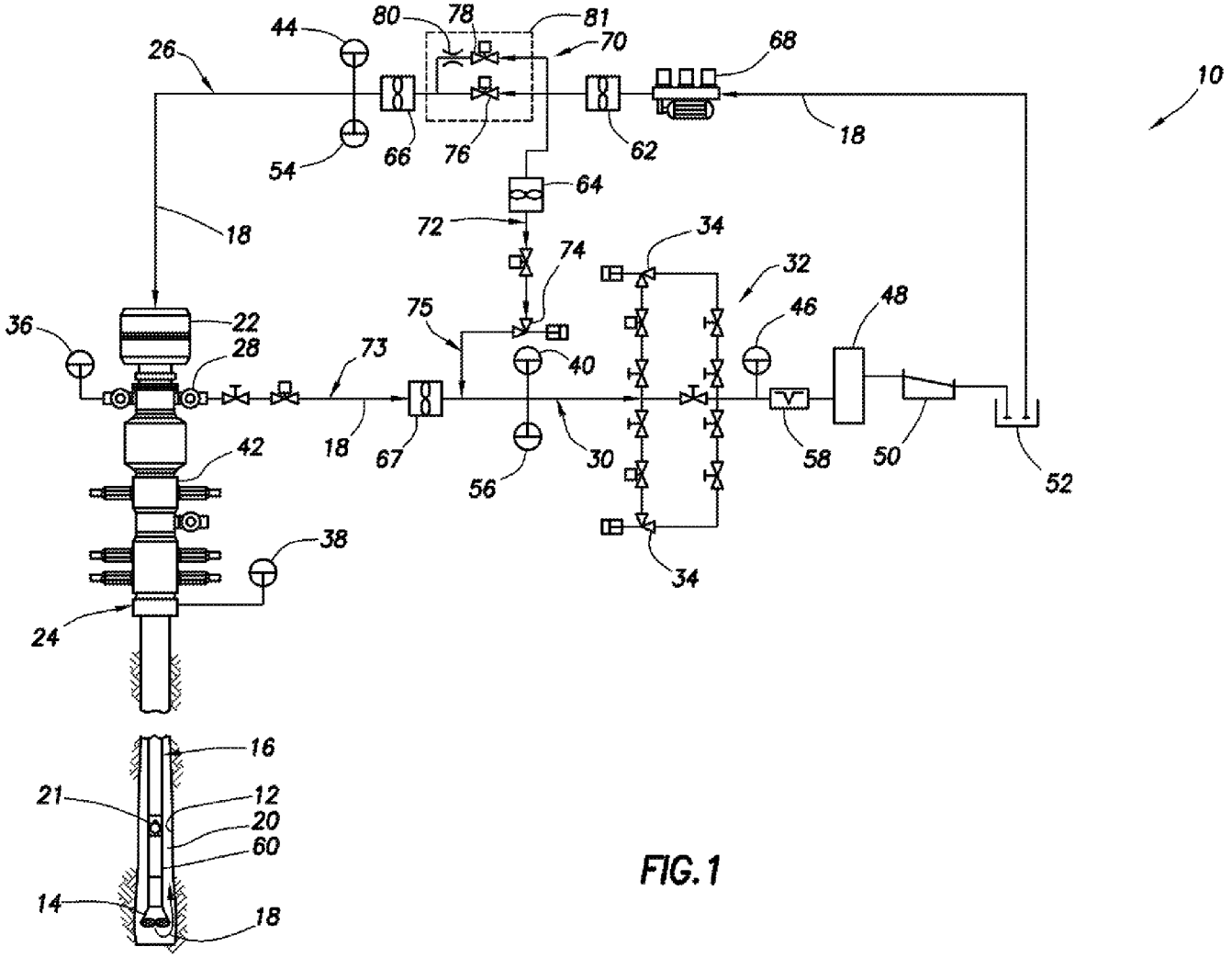
FIG. 1 is a representative view of a well drilling system and method embodying principles of the present disclosure.

Representatively and schematically illustrated in FIG. 1 is a well drilling system 10 and associated method which can embody principles of this disclosure. In the system 10, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (e.g., when connections are being made in the drill string).

Control of wellbore pressure is very important in managed pressure drilling, and in other types of drilling operations. Preferably, the wellbore pressure is precisely controlled to prevent excessive loss of fluid into the earth formation surrounding the wellbore 12, undesired fracturing of the formation, undesired influx of formation fluids into the wellbore, etc.

In typical managed pressure drilling, it is desired to maintain the wellbore pressure just slightly greater than a pore pressure of the formation penetrated by the wellbore, without exceeding a fracture pressure of the formation. This technique is especially useful in situations where the margin between pore pressure and fracture pressure is relatively small.

In typical underbalanced drilling, it is desired to maintain the wellbore pressure somewhat less than the pore pressure, thereby obtaining a controlled influx of fluid from the formation. In typical overbalanced drilling, it is desired to maintain the wellbore pressure somewhat greater than the pore pressure, thereby preventing (or at least mitigating) influx of fluid from the formation.

Nitrogen or another gas, or another lighter weight fluid, may be added to the drilling fluid 18 for pressure control. This technique is useful, for example, in underbalanced drilling operations.

In the system 10, additional control over the wellbore pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through mud return lines 30, 73 to a choke manifold 32, which includes redundant chokes 34 (only one of which might be used at a time). Backpressure is applied to the annulus 20 by variably restricting flow of the fluid 18 through the operative choke (s) 34.

The greater the restriction to flow through the choke 34, the greater the backpressure applied to the annulus 20. Thus, downhole pressure (e.g., pressure at the bottom of the wellbore 12, pressure at a downhole casing shoe, pressure at a particular formation or zone, etc.) can be conveniently regulated by varying the backpressure applied to the annulus 20. A hydraulics model can be used, as described more fully below, to determine a pressure applied to the annulus 20 at or near the surface which will result in a desired downhole pressure, so that an operator (or an automated control system) can readily determine how to regulate the pressure applied to the annulus at or near the surface (which can be conveniently measured) in order to obtain the desired downhole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the mud return lines 30, 73 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66.

Not all of these sensors are necessary. For example, the system 10 could include only two of the three flowmeters 62, 64, 66. However, input from all available sensors is useful to the hydraulics model in determining what the pressure applied to the annulus 20 should be during the drilling operation.

Other sensor types may be used, if desired. For example, it is not necessary for the flowmeter 58 to be a Coriolis flowmeter, since a turbine flowmeter, acoustic flowmeter, or another type of flowmeter could be used instead.

In addition, the drill string 16 may include its own sensors 60, for example, to directly measure downhole pressure. Such sensors 60 may be of the type known to those skilled in the art as pressure while drilling (PWD), measurement while drilling (MWD) and/or logging while drilling (LWD). These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of wired or wireless telemetry (acoustic, pressure pulse, electromagnetic, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using the flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 70 to the standpipe 26. The fluid then circulates downward through the drill string 16, upward through the annulus 20, through the mud return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the downhole pressure, unless the fluid 18 is flowing through the choke. In conventional overbalanced drilling operations, a lack of fluid 18 flow will occur, for example, whenever a connection is made in the drill string 16 (e.g., to add another length of drill pipe to the drill string as the wellbore 12 is drilled deeper), and the lack of circulation will require that downhole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string. Thus, pressure can still be applied to the annulus 20 by restricting flow of the fluid 18 through the choke 34, even though a separate backpressure pump may not be used.

When fluid 18 is not circulating through drill string 16 and annulus 20 (e.g., when a connection is made in the drill string), the fluid is flowed from the pump 68 to the choke manifold 32 via a bypass line 72, 75. Thus, the fluid 18 can bypass the standpipe line 26, drill string 16 and annulus 20, and can flow directly from the pump 68 to the mud return line 30, which remains in communication with the annulus 20. Restriction of this flow by the choke 34 will thereby cause pressure to be applied to the annulus 20 (for example, in typical managed pressure drilling).

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20.

Although this might require some additional piping at the rig site, the effect on the annulus pressure would be essentially the same as connecting the bypass line 75 and the mud return line 30 to the common line 73. Thus, it should be appreciated that various different configurations of the components of the system 10 may be used, and still remain within the scope of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe line 26 is substantially controlled by a valve or other type of flow control device 76. Note that the flow control devices 74, 76 are independently controllable, which provides substantial benefits to the system 10, as described more fully below.

Since the rate of flow of the fluid 18 through each of the standpipe and bypass lines 26, 72 is useful in determining how wellbore pressure is affected by these flows, the flowmeters 64, 66 are depicted in FIG. 1 as being interconnected in these lines. However, the rate of flow through the standpipe line 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

In the FIG. 1 example, a bypass flow control device 78 and flow restrictor 80 may be used for filling the standpipe line 26 and drill string 16 after a connection is made in the drill string, and for equalizing pressure between the standpipe line and mud return lines 30, 73 prior to opening the flow control device 76. Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe line and drill string fill with fluid, etc.).

By opening the standpipe bypass flow control device 78 after a connection is made, the fluid 18 is permitted to fill the standpipe line 26 and drill string 16 while a substantial majority of the fluid continues to flow through the bypass line 72, thereby enabling continued controlled application of pressure to the annulus 20. After the pressure in the standpipe line 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe line 26.

Before a connection is made in the drill string 16, a similar process can be performed, except in reverse, to gradually divert flow of the fluid 18 from the standpipe line 26 to the bypass line 72 in preparation for adding more drill pipe to the drill string 16. That is, the flow control device 74 can be gradually opened to slowly divert a greater proportion of the fluid 18 from the standpipe line 26 to the bypass line 72, and then the flow control device 76 can be closed.

Note that the flow control device 78 and flow restrictor 80 could be integrated into a single element (e.g., a flow control device having a flow restriction therein), and the flow control devices 76, 78 could be integrated into a single flow control device 81 (e.g., a single choke which can gradually open to slowly fill and pressurize the standpipe line 26 and drill string 16 after a drill pipe connection is made, and then open fully to allow maximum flow while drilling).

However, since typical conventional drilling rigs are equipped with the flow control device 76 in the form of a valve in the standpipe manifold 70, and use of the standpipe valve is incorporated into usual drilling practices, the individually operable flow control devices 76, 78 preserve the use of the flow control device 76. The flow control devices 76, 78 are at times referred to collectively below as though they are the single flow control device 81, but it should be understood that the flow control device 81 can include the individual flow control devices 76, 78.

Figure 2:
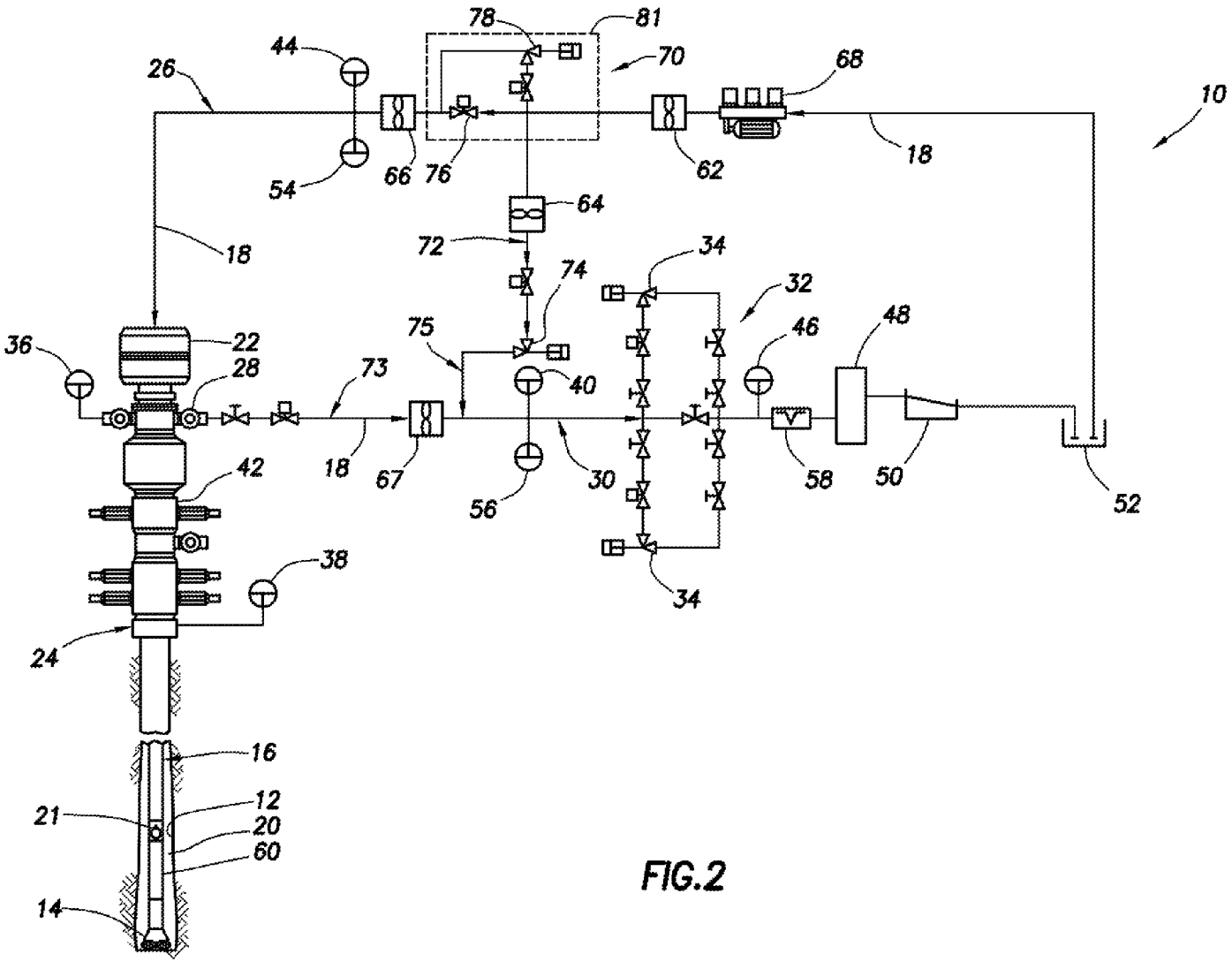
FIG. 2 is a representative view of another configuration of the well drilling system.

Another alternative is representatively illustrated in FIG. 2. In this example, the flow control device 78 is in the form of a choke, and the flow restrictor 80 is not used. The flow control device 78 depicted in FIG. 2 enables more precise control over the flow of the fluid 18 into the standpipe line 26 and drill string 16 after a drill pipe connection is made.

Note that each of the flow control devices 74, 76, 78 and chokes 34 are preferably remotely and automatically controllable to maintain a desired downhole pressure by maintaining a desired annulus pressure at or near the surface. However, any one or more of these flow control devices 74, 76, 78 and chokes 34 could be manually controlled, in keeping with the scope of this disclosure.

Figure 3:
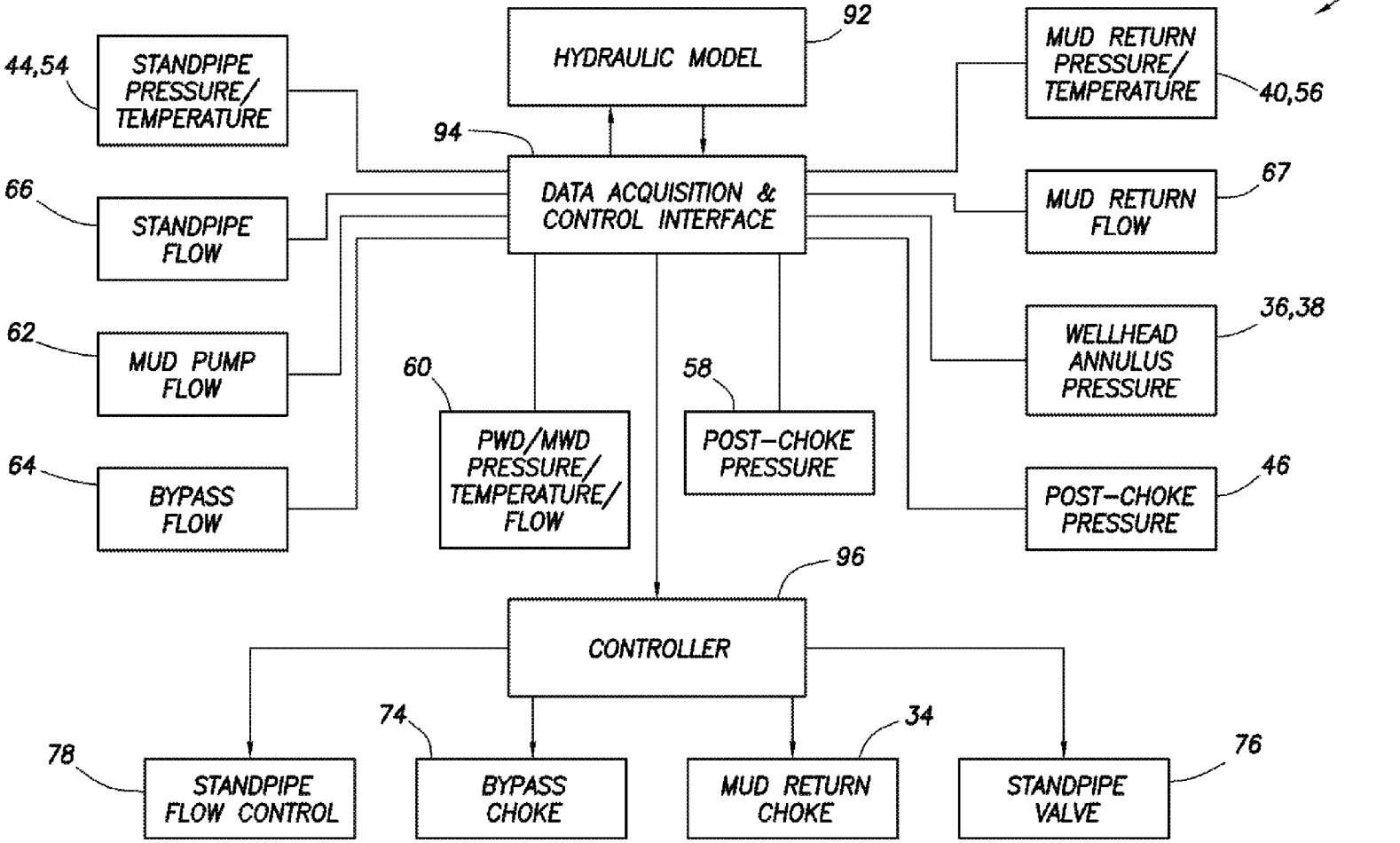
FIG. 3 is a representative block diagram of a pressure and flow control system which may be used in the well drilling system and method.

A pressure and flow control system 90 which may be used in conjunction with the system 10 and associated methods of FIGS. 1 & 2 is representatively illustrated in FIG. 3. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as a programmable logic controller or PLC, a suitably programmed computer, etc.). Although these elements 92, 94, 96 are depicted separately in FIG. 3, any or all of them could be combined into a single element, or the functions of the elements could be separated into additional elements, other additional elements and/or functions could be provided, etc.

The hydraulics model 92 is used in the control system 90 to determine the desired annulus pressure at or near the surface to achieve a desired downhole pressure. Data such as well geometry, fluid properties and offset well information (such as geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. It is important to appreciate that the data acquisition and control interface 94 operates to maintain a substantially continuous flow of real-time data from the sensors 44, 54, 66, 62, 64, 60, 58, 46, 36, 38, 40, 56, 67 to the hydraulics model 92, so that the hydraulics model has the information it needs to adapt to changing circumstances and to update the desired annulus pressure, and the hydraulics model operates to supply the data acquisition and control interface substantially continuously with a value for the desired annulus pressure.

A suitable hydraulics model for use as the hydraulics model 92 in the control system 90 is REAL TIME HYDRAULICS™ marketed by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ marketed by Halliburton Energy Services, Inc. Any suitable data acquisition and control interface may be used in the control system 90 in keeping with the principles of this disclosure.

The controller 96 operates to maintain a desired setpoint annulus pressure by controlling operation of the mud return choke 34. When an updated desired annulus pressure is transmitted from the data acquisition and control interface 94 to the controller 96, the controller uses the desired annulus pressure as a setpoint and controls operation of the choke 34 in a manner (e.g., increasing or decreasing flow resistance through the choke as needed) to maintain the setpoint pressure in the annulus 20. The choke 34 can be closed more to increase flow resistance, or opened more to decrease flow resistance.

Maintenance of the setpoint pressure is accomplished by comparing the setpoint pressure to a measured annulus pressure (such as the pressure sensed by any of the sensors 36, 38, 40), and decreasing flow resistance through the choke 34 if the measured pressure is greater than the setpoint pressure, and increasing flow resistance through the choke if the measured pressure is less than the setpoint pressure. Of course, if the setpoint and measured pressures are the same, then no adjustment of the choke 34 is required. This process is preferably automated, so that no human intervention is required, although human intervention may be used, if desired.

The controller 96 may also be used to control operation of the standpipe flow control devices 76, 78 and the bypass flow control device 74. The controller 96 can, thus, be used to automate the processes of diverting flow of the fluid 18 from the standpipe line 26 to the bypass line 72 prior to making a connection in the drill string 16, then diverting flow from the bypass line to the standpipe line after the connection is made, and then resuming normal circulation of the fluid 18 for drilling. Again, no human intervention may be required in these automated processes, although human intervention may be used if desired, for example, to initiate each process in turn, to manually operate a component of the system, etc.

Figure 4:
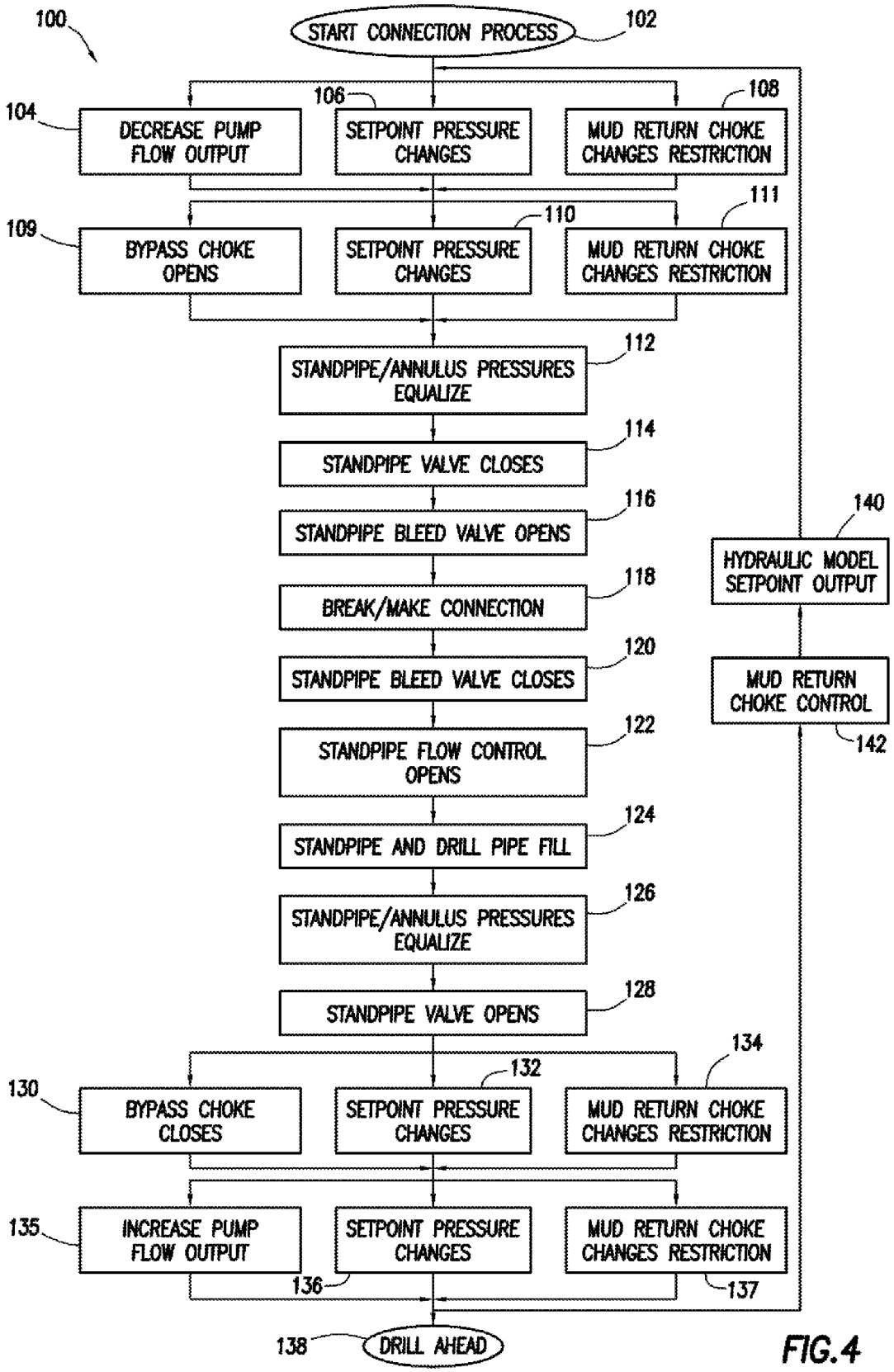
FIG. 4 is a representative flowchart of a method for making a drill string connection which may be used in the well drilling system and method.

Referring additionally now to FIG. 4, a schematic flowchart is provided for a method 100 for making a drill pipe connection in the well drilling system 10 using the control system 90. Of course, the method 100 may be used in other well drilling systems, and with other control systems, in keeping with the principles of this disclosure.

The drill pipe connection process begins at step 102, in which the process is initiated. A drill pipe connection is typically made when the wellbore 12 has been drilled far enough that the drill string 16 must be elongated in order to drill further.

In step 104, the flow rate output of the pump 68 may be decreased. By decreasing the flow rate of the fluid 18 output from the pump 68, it is more convenient to maintain the choke 34 within its most effective operating range (typically, from about 30% to about 70% of maximum opening) during the connection process. However, this step is not necessary if, for example, the choke 34 would otherwise remain within its effective operating range.

In step 106, the setpoint pressure changes due to the reduced flow of the fluid 18 (e.g., to compensate for decreased fluid friction in the annulus 20 between the bit 14 and the wing valve 28 resulting in reduced equivalent circulating density). The data acquisition and control interface 94 receives indications (e.g., from the sensors 58, 60, 62, 66, 67) that the flow rate of the fluid 18 has decreased, and the hydraulics model 92 in response determines that a changed annulus pressure is desired to maintain the desired downhole pressure, and the controller 96 uses the changed desired annulus pressure as a setpoint to control operation of the choke 34.

In a slightly overbalanced managed pressure drilling operation, the setpoint pressure would likely increase, due to the reduced equivalent circulating density, in which case flow resistance through the choke 34 would be increased in response. However, in some operations (such as, underbalanced drilling operations in which gas or another light weight fluid is added to the drilling fluid 18 to decrease bottom hole pressure), the setpoint pressure could decrease (e.g., due to production of liquid downhole).

In step 108, the restriction to flow of the fluid 18 through the choke 34 is changed, due to the changed desired annulus pressure in step 106. As discussed above, the controller 96 controls operation of the choke 34, in this case changing the restriction to flow through the choke to obtain the changed setpoint pressure. Also as discussed above, the setpoint pressure could increase or decrease.

Steps 104, 106 and 108 are depicted in the FIG. 4 flowchart as being performed concurrently, since the setpoint pressure and mud return choke restriction can continuously vary, whether in response to each other, in response to the change in the mud pump output and in response to other conditions, as discussed above.

In step 109, the bypass flow control device 74 gradually opens. This diverts a gradually increasing proportion of the fluid 18 to flow through the bypass line 72, instead of through the standpipe line 26.

In step 110, the setpoint pressure changes due to the reduced flow of the fluid 18 through the drill string 16 (e.g., to compensate for decreased fluid friction in the annulus 20 between the bit 14 and the wing valve 28 resulting in reduced equivalent circulating density). Flow through the drill string 16 is substantially reduced when the bypass flow control device 74 is opened, since the bypass line 72 becomes the path of least resistance to flow and, therefore, fluid 18 flows through bypass line 72. The data acquisition and control interface 94 receives indications (e.g., from the sensors 58, 60, 62, 66, 67) that the flow rate of the fluid 18 through the drill pipe 16 and annulus 20 has decreased, and the hydraulics model 92 in response determines that a changed annulus pressure is desired to maintain the desired downhole pressure, and the controller 96 uses the changed desired annulus pressure as a setpoint to control operation of the choke 34.

In a slightly overbalanced managed pressure drilling operation, the setpoint pressure would likely increase, due to the reduced equivalent circulating density, in which case flow restriction through the choke 34 would be increased in response. However, in some operations (such as, underbalanced drilling operations in which gas or another light weight fluid is added to the drilling fluid 18 to decrease bottom hole pressure), the setpoint pressure could decrease (e.g., due to production of liquid downhole).

In step 111, the restriction to flow of the fluid 18 through the choke 34 is changed, due to the changed desired annulus pressure in step 110. As discussed above, the controller 96 controls operation of the choke 34, in this case changing the restriction to flow through the choke to obtain the changed setpoint pressure. Also as discussed above, the setpoint pressure could increase or decrease.

Steps 109, 110 and 111 are depicted in the FIG. 4 flowchart as being performed concurrently, since the setpoint pressure and mud return choke restriction can continuously vary, whether in response to each other, in response to the bypass flow control device 74 opening and in response to other conditions, as discussed above. However, these steps could be performed non-concurrently in other examples.

In step 112, the pressures in the standpipe line 26 and the annulus 20 at or near the surface (indicated by sensors 36, 38, 40, 44) equalize. At this point, the bypass flow control device 74 should be fully open, and substantially all of the fluid 18 is flowing through the bypass line 72, 75 and not through the standpipe line 26 (since the bypass line represents the path of least resistance). Static pressure in the standpipe line 26 should substantially equalize with pressure in the lines 30, 73, 75 upstream of the choke manifold 32.

In step 114, the standpipe flow control device 81 is closed. The separate standpipe bypass flow control device 78 should already be closed, in which case only the valve 76 would be closed in step 114.

In step 116, a standpipe bleed valve 82 (see FIG. 10) would be opened to bleed pressure and fluid from the standpipe line 26 in preparation for breaking the connection between the kelley or top drive and the drill string 16. At this point, the standpipe line 26 is vented to atmosphere.

In step 118, the kelley or top drive is disconnected from the drill string 16, another stand of drill pipe is connected to the drill string, and the kelley or top drive is connected to the top of the drill string. This step is performed in accordance with conventional drilling practice, with at least one exception, in that it is conventional drilling practice to turn the rig pumps off while making a connection. In the method 100, however, the rig pumps 68 preferably remain on, but the standpipe valve 76 is closed and all flow is diverted to the choke manifold 32 for annulus pressure control. Non-return valve 21 prevents flow upward through the drill string 16 while making a connection with the rig pumps 68 on.

In step 120, the standpipe bleed valve 82 is closed. The standpipe line 26 is, thus, isolated again from atmosphere, but the standpipe line and the newly added stand of drill pipe are substantially empty (i.e., not filled with the fluid 18) and the pressure therein is at or near ambient pressure before the connection is made.

In step 122, the standpipe bypass flow control device 78 opens (in the case of the valve and flow restrictor configuration of FIG. 1) or gradually opens (in the case of the choke configuration of FIG. 2). In this manner, the fluid 18 is allowed to fill the standpipe line 26 and the newly added stand of drill pipe, as indicated in step 124.

Eventually, the pressure in the standpipe line 26 will equalize with the pressure in the annulus 20 at or near the surface, as indicated in step 126. However, substantially all of the fluid 18 will still flow through the bypass line 72 at this point. Static pressure in the standpipe line 26 should substantially equalize with pressure in the lines 30, 73, 75 upstream of the choke manifold 32.

In step 128, the standpipe flow control device 76 is opened in preparation for diverting flow of the fluid 18 to the standpipe line 26 and thence through the drill string 16. The standpipe bypass flow control device 78 is then closed. Note that, by previously filling the standpipe line 26 and drill string 16, and equalizing pressures between the standpipe line and the annulus 20, the step of opening the standpipe flow control device 76 does not cause any significant undesirable pressure transients in the annulus or mud return lines 30, 73. Substantially all of the fluid 18 still flows through the bypass line 72, instead of through the standpipe line 26, even though the standpipe flow control device 76 is opened.

Considering the separate standpipe flow control devices 76, 78 as a single standpipe flow control device 81, then the flow control device 81 is gradually opened to slowly fill the standpipe line 26 and drill string 16, and then fully opened when pressures in the standpipe line and annulus 20 are substantially equalized.

In step 130, the bypass flow control device 74 is gradually closed, thereby diverting an increasingly greater proportion of the fluid 18 to flow through the standpipe line 26 and drill string 16, instead of through the bypass line 72. During this step, circulation of the fluid 18 begins through the drill string 16 and wellbore 12.

In step 132, the setpoint pressure changes due to the flow of the fluid 18 through the drill string 16 and annulus 20 (e.g., to compensate for increased fluid friction resulting in increased equivalent circulating density). The data acquisition and control interface 94 receives indications (e.g., from the sensors 60, 64, 66, 67) that the flow rate of the fluid 18 through the wellbore 12 has increased, and the hydraulics model 92 in response determines that a changed annulus pressure is desired to maintain the desired downhole pressure, and the controller 96 uses the changed desired annulus pressure as a setpoint to control operation of the choke 34. The desired annulus pressure may either increase or decrease, as discussed above for steps 106 and 108.

In step 134, the restriction to flow of the fluid 18 through the choke 34 is changed, due to the changed desired annulus pressure in step 132. As discussed above, the controller 96 controls operation of the choke 34, in this case changing the restriction to flow through the choke to obtain the changed setpoint pressure.

Steps 130, 132 and 134 are depicted in the FIG. 4 flowchart as being performed concurrently, since the setpoint pressure and mud return choke restriction can continuously vary, whether in response to each other, in response to the bypass flow control device 74 closing and in response to other conditions, as discussed above.

In step 135, the flow rate output from the pump 68 may be increased in preparation for resuming drilling of the wellbore 12. This increased flow rate maintains the choke 34 in its optimum operating range, but this step (as with step 104 discussed above) may not be used if the choke is otherwise maintained in its optimum operating range.

In step 136, the setpoint pressure changes due to the increased flow of the fluid 18 (e.g., to compensate for increased fluid friction in the annulus 20 between the bit 14 and the wing valve 28 resulting in increased equivalent circulating density). The data acquisition and control interface 94 receives indications (e.g., from the sensors 58, 60, 62, 66, 67) that the flow rate of the fluid 18 has increased, and the hydraulics model 92 in response determines that a changed annulus pressure is desired to maintain the desired downhole pressure, and the controller 96 uses the changed desired annulus pressure as a setpoint to control operation of the choke 34.

In a slightly overbalanced managed pressure drilling operation, the setpoint pressure would likely decrease, due to the increased equivalent circulating density, in which case flow restriction through the choke 34 would be decreased in response.

In step 137, the restriction to flow of the fluid 18 through the choke 34 is changed, due to the changed desired annulus pressure in step 136. As discussed above, the controller 96 controls operation of the choke 34, in this case changing the restriction to flow through the choke to obtain the changed setpoint pressure. Also as discussed above, the setpoint pressure could increase or decrease.

Steps 135, 136 and 137 are depicted in the FIG. 4 flowchart as being performed concurrently, since the setpoint pressure and mud return choke restriction can continuously vary, whether in response to each other, in response to the change in the mud pump output and in response to other conditions, as discussed above.

In step 138, drilling of the wellbore 12 resumes. When another connection is needed in the drill string 16, steps 102-138 can be repeated.

Steps 140 and 142 are included in the FIG. 4 flowchart for the connection method 100 to emphasize that the control system 90 continues to operate throughout the method. That is, the data acquisition and control interface 94 continues to receive data from the sensors 36, 38, 40, 44, 46, 54, 56, 58, 62, 64, 66, 67, and continues to supply appropriate data to the hydraulics model 92. The hydraulics model 92 continues to determine the desired annulus pressure corresponding to the desired downhole pressure. The controller 96 continues to use the desired annulus pressure as a setpoint pressure for controlling operation of the choke 34.

It will be appreciated that all or most of the steps described above may be conveniently automated using the control system 90. For example, the controller 96 may be used to control operation of any or all of the flow control devices 34, 74, 76, 78, 81 automatically in response to input from the data acquisition and control interface 94.

Human intervention would preferably be used to indicate to the control system 90 when it is desired to begin the connection process (step 102), and then to indicate when a drill pipe connection has been made (step 118), but substantially all of the other steps could be automated (e.g., by suitably programming the software elements of the control system 90). However, it is envisioned that all of the steps 102-142 can be automated, for example, if a suitable top drive drilling rig (or any other drilling rig which enables drill pipe connections to be made without human intervention) is used.

Figure 5:
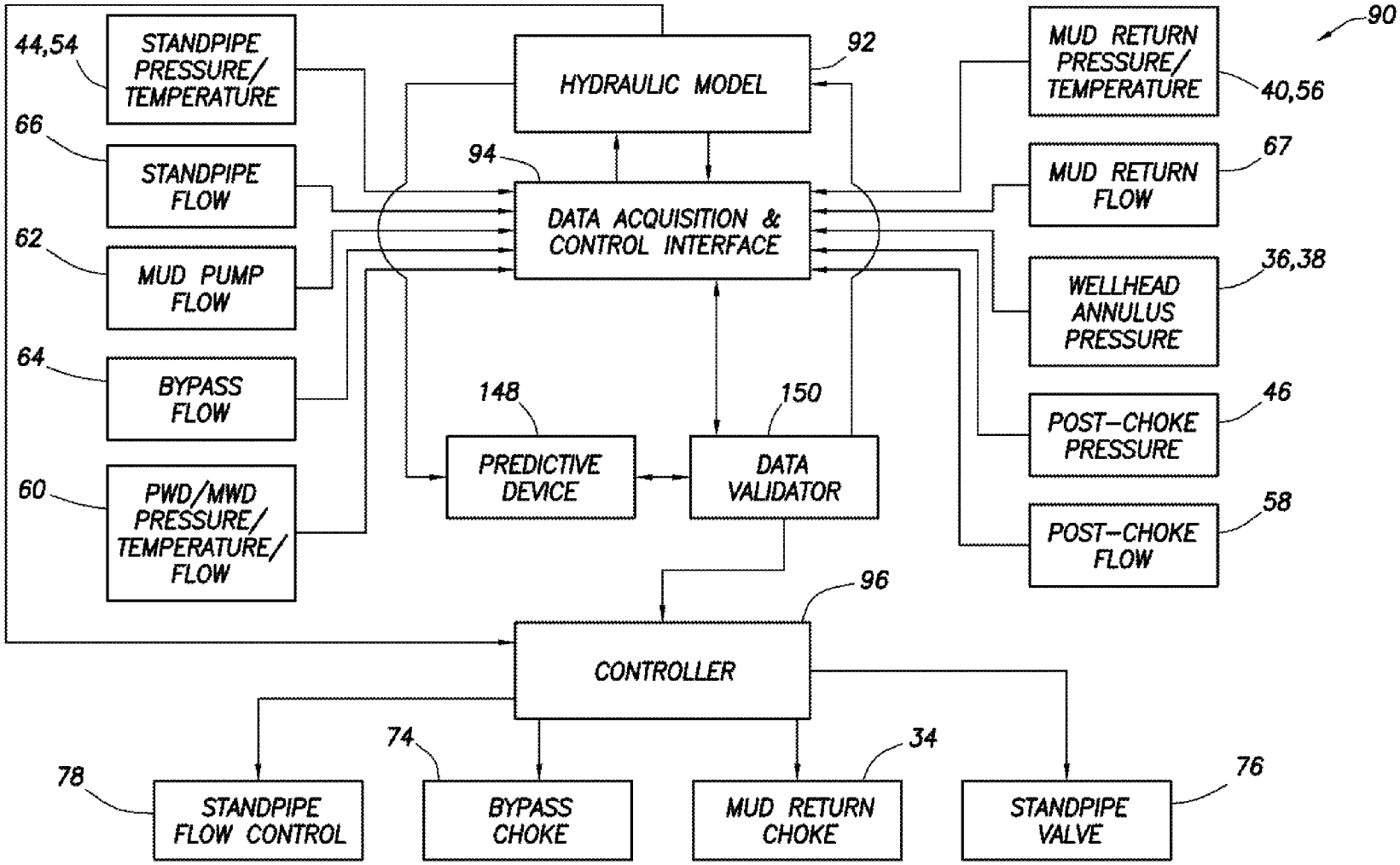
FIG. 5 is a representative block diagram of another configuration of the pressure and flow control system.

Referring additionally now to FIG. 5, another configuration of the control system 90 is representatively illustrated. The control system 90 of FIG. 5 is very similar to the control system of FIG. 3, but differs at least in that a predictive device 148 and a data validator 150 are included in the control system of FIG. 5.

The predictive device 148 preferably comprises one or more neural network models for predicting various well parameters. These parameters could include outputs of any of the sensors 36, 38, 40, 44, 46, 54, 56, 58, 60, 62, 64, 66, 67, the annulus pressure setpoint output from the hydraulic model 92, positions of flow control devices 34, 74, 76, 78, drilling fluid 18 density, etc. Any well parameter, and any combination of well parameters, may be predicted by the predictive device 148.

The predictive device 148 is preferably "trained" by inputting present and past actual values for the parameters to the predictive device. Terms or "weights" in the predictive device 148 may be adjusted based on derivatives of output of the predictive device with respect to the terms.

The predictive device 148 may be trained by inputting to the predictive device data obtained during drilling, while making connections in the drill string 16, and/or during other stages of an overall drilling operation. The predictive device 148 may be trained by inputting to the predictive device data obtained while drilling at least one prior wellbore.

The training may include inputting to the predictive device 148 data indicative of past errors in predictions produced by the predictive device. The predictive device 148 may be trained by inputting data generated by a computer simulation of the well drilling system 10 (including the drilling rig, the well, equipment utilized, etc.).

Once trained, the predictive device 148 can accurately predict or estimate what value one or more parameters should have in the present and/or future. The predicted parameter values can be supplied to the data validator 150 for use in its data validation processes.

The predictive device 148 does not necessarily comprise one or more neural network models. Other types of predictive devices which may be used include an artificial intelligence device, an adaptive model, a nonlinear function which generalizes for real systems, a genetic algorithm, a linear system model, and/or a nonlinear system model, combinations of these, etc.

The predictive device 148 may perform a regression analysis, perform regression on a nonlinear function and may utilize granular computing. An output of a first principle model may be input to the predictive device 148 and/or a first principle model may be included in the predictive device.

The predictive device 148 receives the actual parameter values from the data validator 150, which can include one or more digital programmable processors, memory, etc. The data validator 150 uses various pre-programmed algorithms to determine whether sensor measurements, flow control device positions, etc., received from the data acquisition & control interface 94 are valid.

For example, if a received actual parameter value is outside of an acceptable range, unavailable (e.g., due to a non-functioning sensor) or differs by more than a predetermined maximum amount from a predicted value for that parameter (e.g., due to a malfunctioning sensor), then the data validator 150 may flag that actual parameter value as being "invalid." Invalid parameter values may not be used for training the predictive device 148, or for determining the desired annulus pressure setpoint by the hydraulics model 92. Valid parameter values would be used for training the predictive device 148, for updating the hydraulics model 92, for recording to the data acquisition & control interface 94 database and, in the case of the desired annulus pressure setpoint, transmitted to the controller 96 for controlling operation of the flow control devices 34, 74, 76, 78.

The desired annulus pressure setpoint may be communicated from the hydraulics model 92 to each of the data acquisition & control interface 94, the predictive device 148 and the controller 96. The desired annulus pressure setpoint is communicated from the hydraulics model 92 to the data acquisition & control interface for recording in its database, and for relaying to the data validator 150 with the other actual parameter values.

The desired annulus pressure setpoint is communicated from the hydraulics model 92 to the predictive device 148 for use in predicting future annulus pressure setpoints. However, the predictive device 148 could receive the desired annulus pressure setpoint (along with the other actual parameter values) from the data validator 150 in other examples.

The desired annulus pressure setpoint is communicated from the hydraulics model 92 to the controller 96 for use in case the data acquisition & control interface 94 or data validator 150 malfunctions, or output from these other devices is otherwise unavailable. In that circumstance, the controller 96 could continue to control operation of the various flow control devices 34, 74, 76, 78 to maintain/achieve the desired pressure in the annulus 20 near the surface.

The predictive device 148 is trained in real time, and is capable of predicting current values of one or more sensor measurements based on the outputs of at least some of the other sensors. Thus, if a sensor output becomes unavailable, the predictive device 148 can supply the missing sensor measurement values to the data validator 150, at least temporarily, until the sensor output again becomes available.

If, for example, during the drill string connection process described above, one of the flowmeters 62, 64, 66 malfunctions, or its output is otherwise unavailable or invalid, then the data validator 150 can substitute the predicted flowmeter output for the actual (or nonexistent) flowmeter output. It is contemplated that, in actual practice, only one or two of the flowmeters 62, 64, 66 may be used. Thus, if the data validator 150 ceases to receive valid output from one of those flowmeters, determination of the proportions of fluid 18 flowing through the standpipe line 26 and bypass line 72 can be output by the predictive device 148. It will be appreciated that measurements of the proportions of fluid 18 flowing through the standpipe line 26 and bypass line 72 are very useful, for example, in calculating equivalent circulating density and/or friction pressure by the hydraulics model 92 during the drill string connection process, or during other processes (such as, telemetry methods which divert flow from the drill string 16, etc.) which can cause changes in equivalent circulating density and/or friction pressure.

Validated parameter values are communicated from the data validator 150 to the hydraulics model 92 and to the controller 96. The hydraulics model 92 utilizes the validated parameter values, and possibly other data streams, to compute the pressure currently present downhole at the point of interest (e.g., at the bottom of the wellbore 12, at a problematic zone, at a casing shoe, etc.), and the desired pressure in the annulus 20 near the surface needed to achieve a desired downhole pressure.

The data validator 150 is programmed to examine the individual parameter values received from the data acquisition & control interface 94 and determine if each falls into a predetermined range of expected values. If the data validator 150 detects that one or more parameter values it received from the data acquisition & control interface 94 is invalid, it may send a signal to the predictive device 148 to stop training the neural network model for the faulty sensor, and to stop training the other models which rely upon parameter values from the faulty sensor to train.

Although the predictive device 148 may stop training one or more neural network models when a sensor fails, it can continue to generate predictions for output of the faulty sensor or sensors based on other, still functioning sensor inputs to the predictive device. Upon identification of a faulty sensor, the data validator 150 can substitute the predicted sensor parameter values from the predictive device 148 to the controller 96 and the hydraulics model 92. Additionally, when the data validator 150 determines that a sensor is malfunctioning or its output is unavailable, the data validator can generate an alarm and/or post a warning, identifying the malfunctioning sensor, so that an operator can take corrective action.

The predictive device 148 is preferably also able to train a neural network model representing the output of the hydraulics model 92. A predicted value for the desired annulus pressure setpoint is communicated to the data validator 150. If the hydraulics model 92 has difficulties in generating proper values or is unavailable, the data validator 150 can substitute the predicted desired annulus pressure setpoint to the controller 96.

Figure 6:
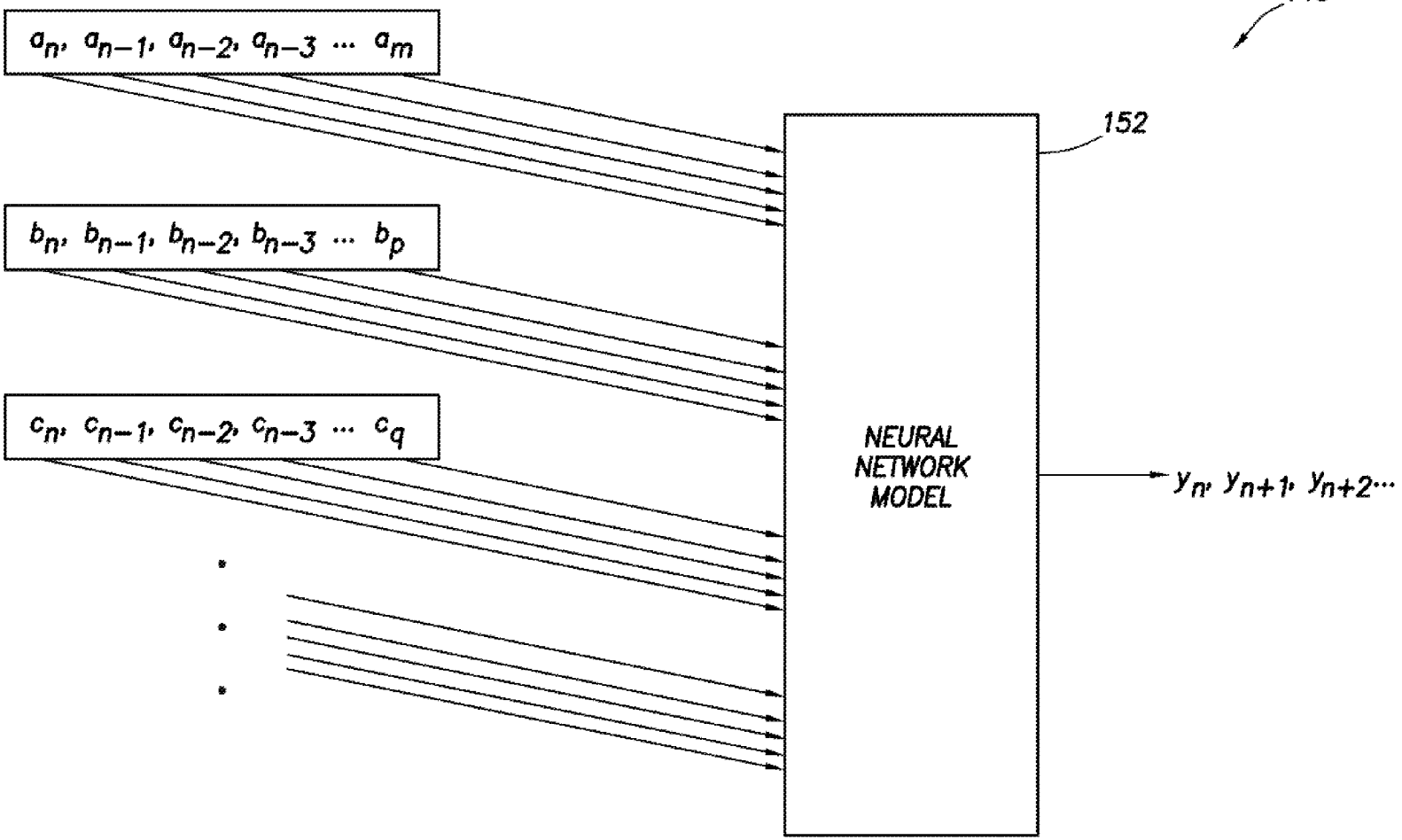
FIGS. 6-8 are representative block diagrams of various configurations of a predictive device which may be used in the pressure and flow control system of FIG. 5.

Referring additionally now to FIG. 6, an example of the predictive device 148 is representatively illustrated, apart from the remainder of the control system 90. In this view, it may be seen that the predictive device 148 includes a neural network model 152 which outputs predicted current ($y_n$) and/or future ($y_{n+1}$, $y_{n+2}$, . . . ) values for a parameter y.

Various other current and/or past values for parameters a, b, c, . . . are input to the neural network model 152 for training the neural network model, for predicting the parameter y values, etc. The parameters a, b, c, . . . , y, . . . may be any of the sensor measurements, flow control device positions, physical parameters (e.g., mud weight, wellbore depth, etc.), etc. described above.

Current and/or past actual and/or predicted values for the parameter y may also be input to the neural network model 152. Differences between the actual and predicted values for the parameter y can be useful in training the neural network model 152 (e.g., in minimizing the differences between the actual and predicted values).

During training, weights are assigned to the various input parameters and those weights are automatically adjusted such that the differences between the actual and predicted parameter values are minimized. If the underlying structure of the neural network model 152 and the input parameters are properly chosen, training should result in very little difference between the actual parameter values and the predicted parameter values after a suitable (and preferably short) training time.

It can be useful for a single neural network model 152 to output predicted parameter values for only a single parameter. Multiple neural network models 152 can be used to predict values for respective multiple parameters. In this manner, if one of the neural network models 152 fails, the others are not affected.

Figure 7:
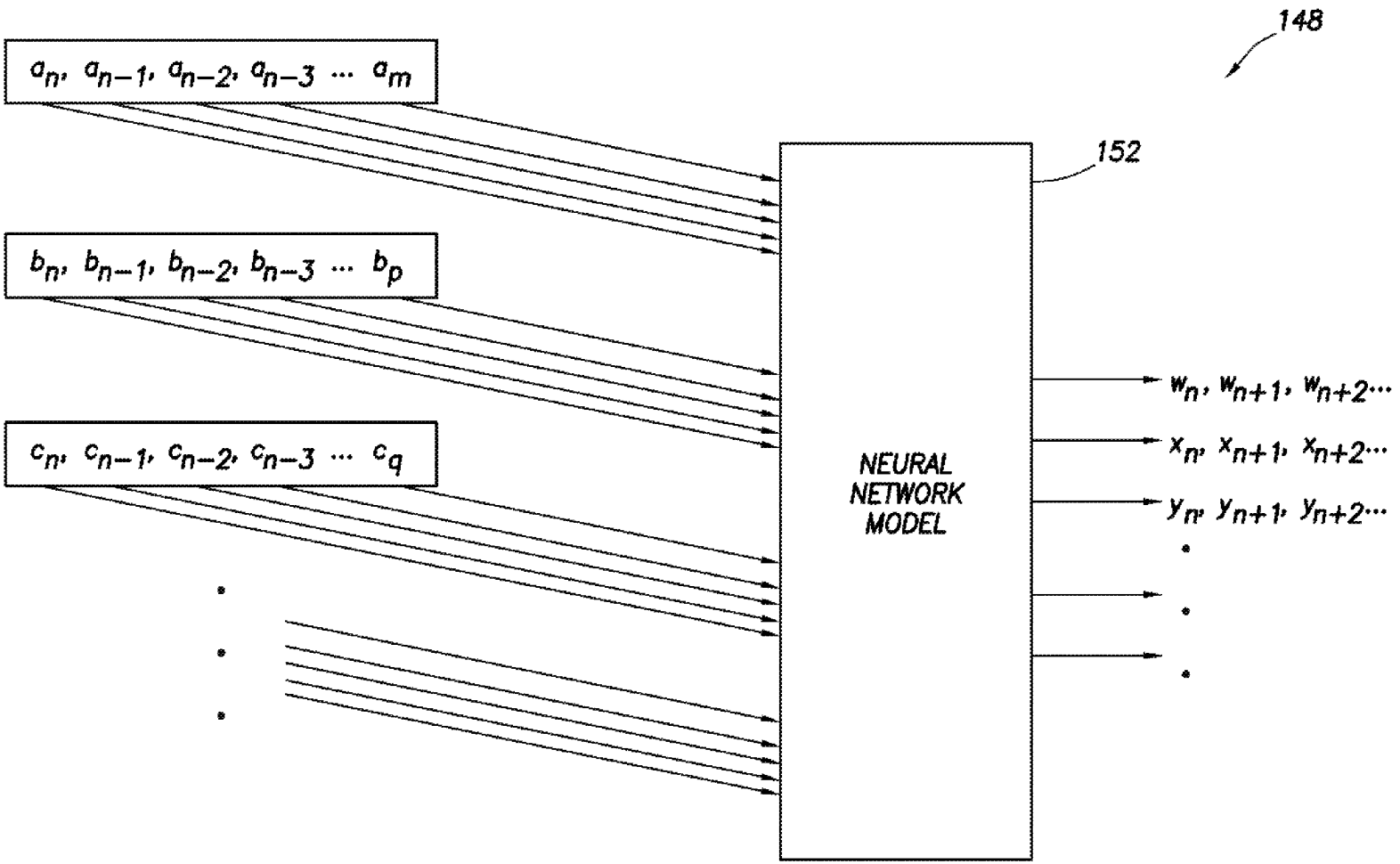

However, efficient utilization of resources might dictate that a single neural network model 152 be used to predict multiple parameter values. Such a configuration is representatively illustrated in FIG. 7, in which the neural network model 152 outputs predicted values for multiple parameters w, x, y . . . .

Figure 8:
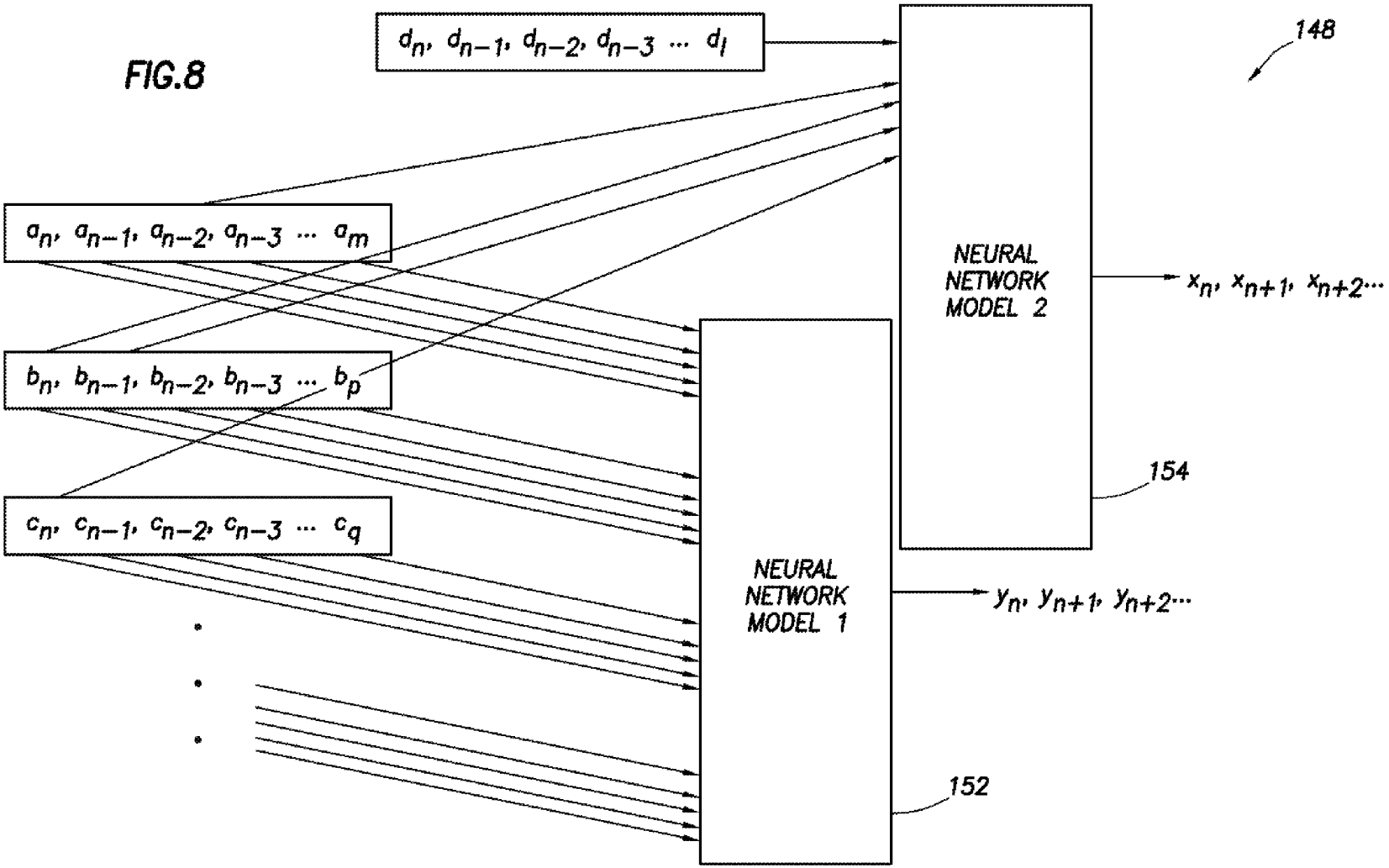

If multiple neural networks are used, it is not necessary for all of the neural networks to share the same inputs. In an example representatively illustrated in FIG. 8, two neural network models 152, 154 are used. The neural network models 152, 154 share some of the same input parameters, but the model 152 has some parameter input values which the model 154 does not share, and the model 154 has parameter input values which are not input to the model 152.

If a neural network model 152 outputs predicted values for only a single parameter associated with a particular sensor (or other source for an actual parameter value), then if that sensor (or other actual parameter value source) fails, the neural network model which predicts its output can be used to supply the parameter values while operations continue uninterrupted. Since the neural network model 152 in this situation is used only for predicting values for a single parameter, training of the neural network model can be conveniently stopped as soon as the failure of the sensor (or other actual parameter value source) occurs, without affecting any of the other neural network models being used to predict other parameter values.

Figure 9:
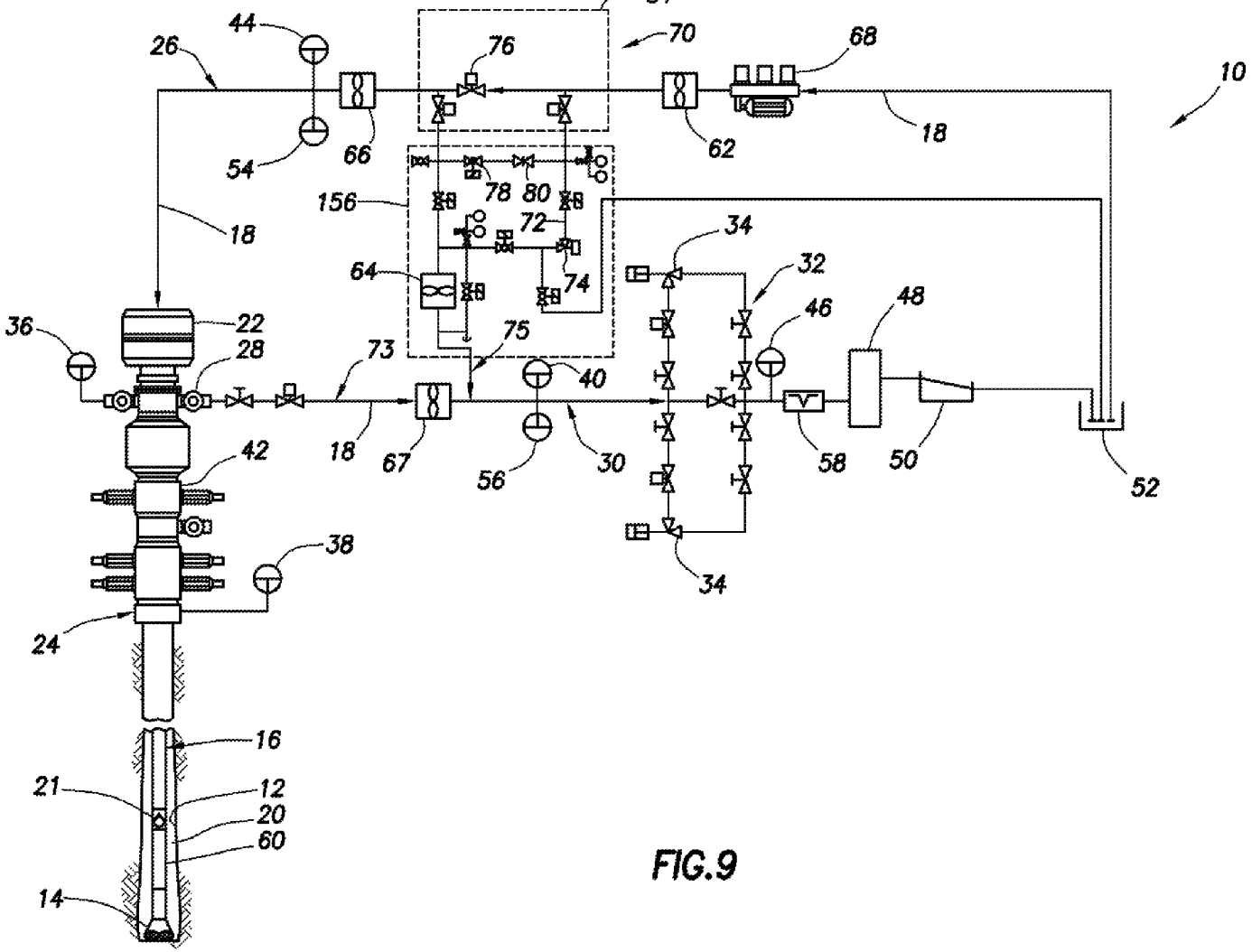
FIG. 9 is a representative view of another configuration of the well drilling system.

Referring additionally now to FIG. 9, another configuration of the well drilling system 10 is representatively and schematically illustrated. The configuration of FIG. 9 is similar in most respects to the configuration of FIG. 2.

However, in the FIG. 9 configuration, the flow control device 78 and flow restrictor 80 are included with the flow control device 74 and flowmeter 64 in a separate flow diversion unit 156. The flow diversion unit 156 can be supplied as a "skid" for convenient transport and installation at a drilling rig site. The choke manifold 32, pressure sensor 46 and flowmeter 58 may also be provided as a separate unit.

Note that use of the flowmeters 66, 67 is optional. For example, the flow through the standpipe line 26 can be inferred from the outputs of the flowmeters 62, 64, and the flow through the mud return line 73 can be inferred from the outputs of the flowmeters 58, 64.

Figure 10:
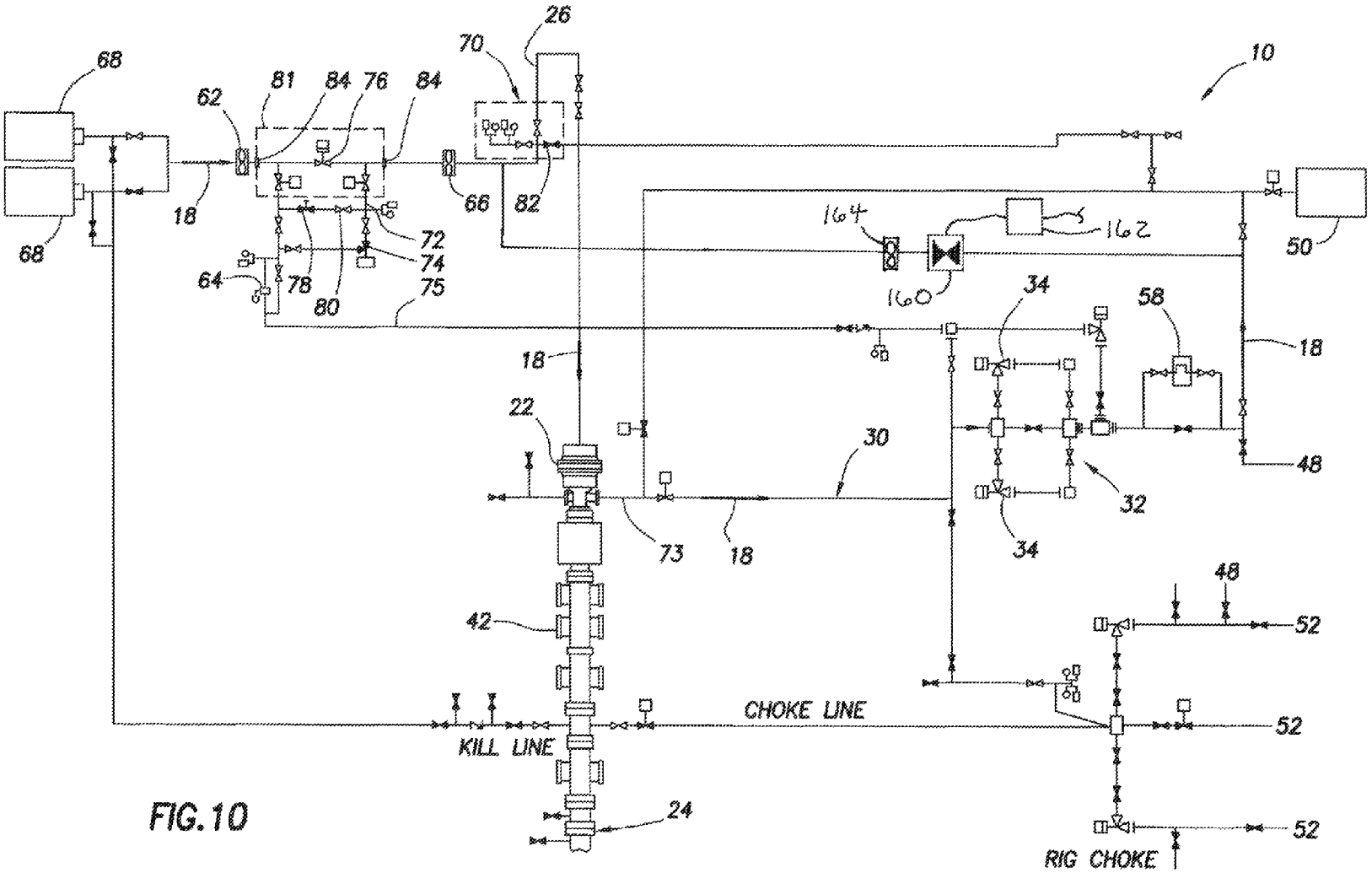
FIG. 10 is a representative view of another configuration of the well drilling system.

Referring additionally now to FIG. 10, another configuration of the well drilling system 10 is representatively and schematically illustrated. In this configuration, the flow control device 76 is connected upstream of the rig's standpipe manifold 70. This arrangement has certain benefits, such as, no modifications are needed to the rig's standpipe manifold 70 or the line between the manifold and the kelley, the rig's standpipe bleed valve 82 can be used to vent the standpipe 26 as in normal drilling operations (no need to change procedure by the rig's crew, no need for a separate venting line from the flow diversion unit 156), etc.

The flow control device 76 can be interconnected between the rig pump 68 and the standpipe manifold 70 using, for example, quick connectors 84 (such as, hammer unions, etc.). This will allow the flow control device 76 to be conveniently adapted for interconnection in various rigs' pump lines.

A specially adapted fully automated flow control device 76 (e.g., controlled automatically by the controller 96) can be used for controlling flow through the standpipe line 26, instead of using the conventional standpipe valve in a rig's standpipe manifold 70. The entire flow control device 81 can be customized for use as described herein (e.g., for controlling flow through the standpipe line 26 in conjunction with diversion of fluid 18 between the standpipe line and the bypass line 72 to thereby control pressure in the annulus 20, etc.), rather than for conventional drilling purposes.

In the FIG. 10 example, a remotely controllable valve or other flow control device 160 is optionally used to divert flow of the fluid 18 from the standpipe line 26 to the mud return line 30, in order to transmit signals, data, commands, etc. to downhole tools (such as the FIG. 1 bottom hole assembly including the sensors 60, other equipment, including mud motors, deflection devices, steering controls, etc.). The device 160 is controlled by a telemetry controller 162, which can encode information as a sequence of flow diversions detectable by the downhole tools (e.g., a certain decrease in flow through a downhole tool will result from a corresponding diversion of flow by the device 160 from the standpipe line 26 to the mud return line 30).

A suitable telemetry controller and a suitable remotely operable flow control device are provided in the GEOSPAN™ system marketed by Halliburton Energy Services, Inc. The telemetry controller 162 can be connected to the INSITE™ system or other acquisition and control interface 94 in the control system 90. However, other types of telemetry controllers and flow control devices may be used in keeping with the scope of this disclosure.

In a method of controlling well pressure described more fully below, the desired annulus pressure setpoint is adjusted in response to an instruction being transmitted to divert flow from the standpipe line 26 to the mud return line 30. Such an instruction could be transmitted at step 109 of the connection method 100 described above. As another example, the instruction could be transmitted by the telemetry controller 162 to the device 160, in order to transmit a corresponding telemetry signal to a downhole tool. In other examples, flow of the fluid 18 may be diverted from the standpipe line 26 and drill string 16 for purposes other than making a connection in the drill string or transmitting signals.

The diversion of flow from the drill string 16 will result in reduced friction pressure, thereby reducing pressure in the wellbore 12. In situations where the initiation of the flow diversion is known (e.g., an instruction will be transmitted to divert the flow), it would be preferable to also initiate a change in the annulus pressure setpoint, to mitigate any pressure changes in the well due to the flow diversion.

This is quite different from changing the annulus pressure setpoint in response to a measured change in pressure downhole, in response to a measured change in flow at the surface, etc. Instead, the change in the annulus pressure setpoint is preferably made directly in response to the instruction to change the flow through the drill string 16.

Thus, actual change(s) in flow or pressure, etc. do not have to occur, do not have to be detected by sensors and do not have to be transmitted to the control system 90 for evaluation of whether the annulus pressure setpoint should be changed. Instead, the annulus pressure setpoint can be changed immediately, preferably without any significant change in pressure occurring downhole.

In practice, it typically will be known how much of the flow of the fluid 18 will be diverted from the drill string 16 (this flow rate can also be measured by means of a flowmeter 164, or deduced from the measurements of other flowmeters 58, 60, 66, etc.), and the total flow of the fluid will be known just prior to the instruction being given to change the flow through the drill string. In these situations, the expected pressure reduction due to reduced flow through the drill string 16 and annulus 20 can be calculated, and the annulus pressure setpoint can be adjusted accordingly (e.g., increased), so that downhole pressure remains substantially unchanged when the diversion begins. Of course, if flow through the drill string 16 is instead increased, then the expected pressure increase due to the increased flow can be calculated, and the annulus pressure setpoint can be adjusted accordingly (e.g., decreased).

In a basic example, the annulus pressure setpoint is typically equal to the desired downhole pressure, minus hydrostatic pressure at the downhole location, minus friction pressure. The friction pressure is calculated by the hydraulic model 92, and is a function of fluid 18 flow rate through the drill string 16 and annulus 20. Thus, an expected change in flow rate will produce an expected change in friction pressure, which can be readily calculated by the hydraulic model 92.

Figure 11:
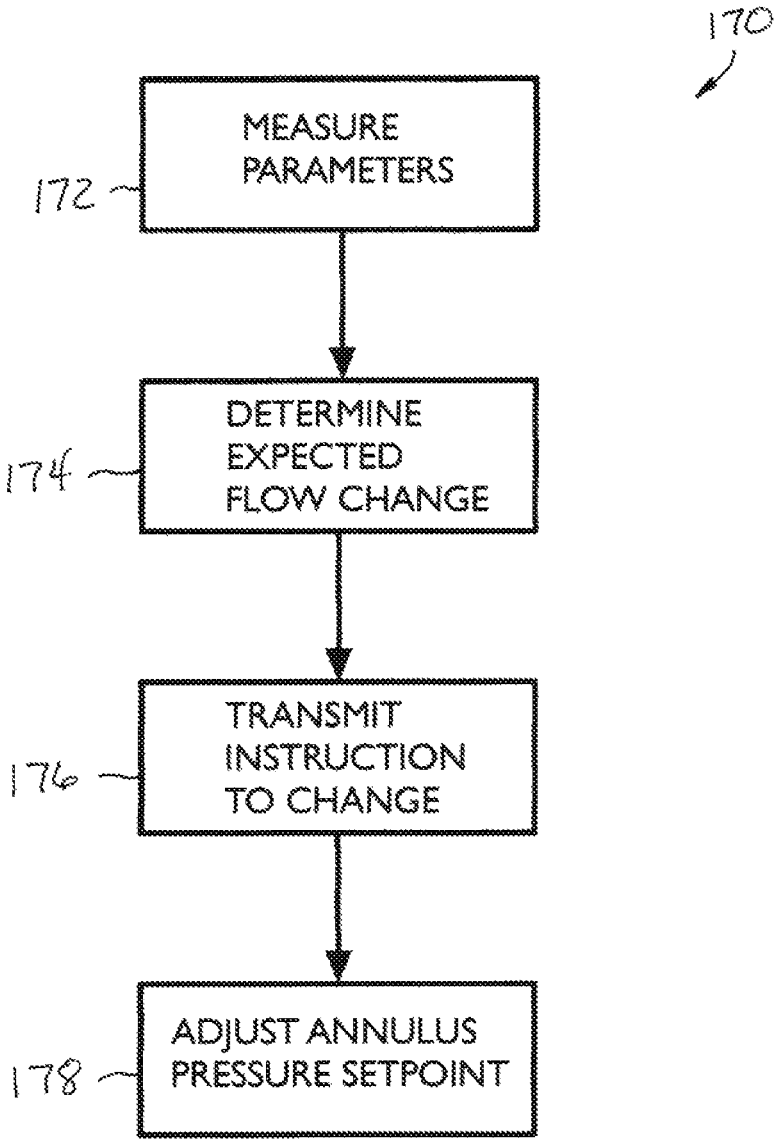
FIG. 11 is a flowchart for a method of controlling well pressure, which method can embody principles of this disclosure.

Referring additionally now to FIG. 11, a flowchart for a method 170 for controlling pressure in a well is representatively illustrated. The method 170 may be used with any of the drilling systems 10 described above, or the method may be used with any other drilling systems, in keeping with the scope of this disclosure.

In the FIG. 11 example, pressure fluctuations downhole due to changes in flow through the drill string 16 and annulus 20 are mitigated or completely prevented. Prior to a change in flow, relevant parameters are measured (e.g., by the sensors 36, 38, 40, 44, 46, 54, 56, 58, 60, 62, 64, 66, 67, 164) in step 172. These measurements inform a determination of an expected flow change in step 174.

In one suitable technique, the diverted fluid 18 flow rate can be calculated using the following equation:

$$\text{Diverted Flow}=e^{\log n((Standpipe-C2)/C0)}/C1 \quad (1)$$

where Standpipe is the actual measured pressure in the standpipe line 26 during diversion of the fluid 18 (such as, during transmission of telemetry signals, etc.), and C0, C1 and C2 are constants derived from a curve fit to measured standpipe pressure versus flow rate through the standpipe.

In another example, the predictive device 148 can be used to predict an expected flow rate change based on various well parameters. These parameters could include outputs of any of the sensors 36, 38, 40, 44, 46, 54, 56, 58, 60, 62, 64, 66, 67, 164 the annulus pressure setpoint output from the hydraulic model 92, choke 34 size(s), positions of flow control devices 34, 74, 76, 78, drilling fluid 18 density, etc. Any well parameter (including current and historical data), and any combination of well parameters, may be utilized by the predictive device 148.

From the expected flow change, the hydraulic model 92 can predict the downhole pressure change due to the flow change, and the change to the pressure setpoint needed to mitigate this downhole pressure change. For example, if it is determined that the flow change will result in reduced pressure at a downhole location, an annulus pressure or standpipe pressure setpoint can be appropriately increased to offset the expected downhole pressure decrease.

In step 176, an instruction is transmitted to change the flow rate through the drill string 16 and annulus 20 by, for example, operating the device 160 of FIG. 10 to divert (or to cease to divert) flow from the standpipe line 26 to the mud return line, operating the flow diversion unit 156 or device 81 of FIG. 9 to change the flow through the standpipe line, etc. Such an instruction could be transmitted by the controller 96 to the flow diversion unit 156, by the controller 162 to the device 160, etc. Any instruction which will result in a change in the rate of flow through the drill string 16 and annulus 20 may be used in keeping with the scope of this disclosure.

In one example, the INSITE™ system mentioned above can issue an instruction or command to begin a downlink process (surface to downhole telemetry), whereby flow through the drill string 16 and annulus 20 is periodically reduced. Such reduction in flow can potentially cause a decrease in pressure downhole.

In step 178, the annulus pressure setpoint is adjusted in response to the instruction being transmitted. If desired, this step can include a requirement for confirmation that the instruction will be executed, or at least that the instruction was appropriately received, prior to the annulus pressure setpoint being adjusted. Further adjustments can be made as needed to maintain a desired downhole pressure, for example, by monitoring various parameters after the instruction to change flow is transmitted, during the change in flow, after the change in flow, etc.

By making the adjustment to the annulus pressure setpoint in response to the instruction being transmitted, downhole pressure changes are mitigated or prevented. Such downhole pressure changes could otherwise possibly result in fluid loss, fracturing of the formation surrounding the wellbore, or failure of a casing shoe (e.g., due to increased downhole pressure), or an influx of fluid into the wellbore from the formation (e.g., due to reduced downhole pressure).

However, in some circumstances it may be useful to permit a limited amount of pressure fluctuation downhole, for example, to allow for communication with downhole tools that respond to pressure changes, etc. In those circumstances, the adjustment to the annulus pressure setpoint can take into account some predetermined permissible pressure variation downhole.

It may now be fully appreciated that the above disclosure provides substantial improvements to the art of pressure and flow control in drilling operations. Among these improvements is the use of the method 170 to reduce or eliminate pressure variations downhole due to changes in flow through the drill string 16 and annulus 20. Where a change in flow is preceded by a known stimulus (such as an instruction to change the flow), pressure variation due to the change in flow can be preempted by promptly adjusting the annulus pressure setpoint in response to the stimulus, rather than waiting for the effects of the change in flow to be detected.

A method 170 of controlling pressure in a well is described above. In one example, the method 170 can include: transmitting an instruction to change flow through an annulus 20 formed radially between a drill string 16 and a wellbore 12; and adjusting a pressure setpoint in response to the transmitting.

The adjusting can be performed prior to flow through the annulus 20 changing, and/or while flow through the annulus 20 changes. The adjusting may be performed prior to the flow change being detected by sensors 36, 38, 40, 44, 46, 54, 56, 58, 60, 62, 64, 66, 67, 164.

The flow change may be caused by diversion of flow from the drill string 16 to a mud return line 30.

The transmitting can comprise encoding information as a sequence of flow variations. For example, the encoded information could be data, commands, instructions, etc. for transmission to one or more downhole tools.

The transmitting comprises initiating a connection in the drill string 16. For example, performance of the connection method 100 will cause changes in flow through the annulus 20 and drill string 16.

The method 170 can include predicting a change in the flow based on measured well parameters. The method may include predicting a downhole pressure change due to the predicted change in the flow.

A well drilling system 10 is also described above. In one example, the system 10 can include a flow control device 74 or 160 which varies flow through a drill string 16. A control system 90 changes a pressure setpoint in response to an instruction for the flow control device 74 or 160 to change the flow through the drill string 16.

The flow control device 74 can divert flow from a standpipe line 26 to a mud return line 30. The flow control device 160 can divert flow from the drill string 16.

The control system 90 may predict a pressure change which will result from the flow change. The pressure setpoint can be adjusted by the predicted pressure change, in response to the instruction.

The pressure setpoint may corresponds to a desired pressure in a wellbore 12, and/or to a desired pressure as measured in an annulus 20 at or near the earth's surface.

Also described above is a method 170 of controlling pressure in a well, with the method 170 in one example comprising transmitting an instruction to divert flow from a drill string 16, and adjusting a pressure setpoint in response to the transmitting.

The adjusting can be performed prior to flow through the drill string 16 being diverted, and/or while flow through the drill string 16 is diverted. The adjusting may be performed prior to the diverting being detected by sensors 36, 38, 40, 44, 46, 54, 56, 58, 60, 62, 64, 66, 67, 164.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which principles are not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of controlling pressure in a well, the method comprising:

measuring a well parameter;

predicting, via a flow control system;

a flow rate change of a fluid in the well from a diversion of fluid from the well based on the well parameter;

a pressure change in the well due to the predicted flow rate change; and an adjustment to a pressure setpoint based on the predicted pressure change;

transmitting an instruction to a flow control device to divert flow of the fluid from the well; and adjusting the pressure setpoint, via the flow control system, based on the predicted pressure setpoint adjustment and the instruction, to control the pressure in the well.

2. The method of claim 1, wherein the adjusting is performed prior to flow through the drill string being diverted.

3. The method of claim 1, wherein the adjusting is performed while flow through the drill string is diverted.

4. The method of claim 1, wherein the flow rate change is caused by diversion of flow from a drill string to a mud return line.

5. The method of claim 1, wherein the transmitting comprises encoding information as a sequence of flow diversions.

6. The method of claim 1, wherein the transmitting comprises initiating a connection in a drill string.

7. The method of claim 1, further comprising predicting a change in a flow rate based on measured well parameters.

8. The method of claim 7, further comprising predicting a downhole pressure change due to a predicted change in a flow rate.

9. The method of claim 1, wherein the adjusting is performed prior to the diverting being detected by sensors.

* * * * *